United States Patent [19]

van den Eijnden

[11] Patent Number: 4,471,210

[45] Date of Patent: Sep. 11, 1984

[54] FUSER HEAT CONTROL CIRCUIT

[75] Inventor: Josephus A. van den Eijnden, Helmond, Netherlands

[73] Assignee: O e-Nederland B.V., Venlo, Netherlands

[21] Appl. No.: 421,049

[22] Filed: Sep. 22, 1982

[30] Foreign Application Priority Data

Oct. 7, 1981 [NL] Netherlands ..... 8104560

[51] Int. Cl.³ ..... G03G 15/20; B21B 27/00

[52] U.S. Cl. ..... 219/216; 355/3 FU; 219/471; 219/469

[58] Field of Search ..... 219/216, 494, 469, 497, 219/471, 504, 505, 470; 355/3 FU, 14 FU; 432/228, 60; 250/316.1-319

[56] References Cited

U.S. PATENT DOCUMENTS

| | | | |
|---|---|---|---|
| 2,526,906 | 10/1950 | Schaab | 219/469 |
| 3,290,485 | 12/1966 | Pettit | 219/470 |
| 3,500,019 | 3/1970 | Childress | 219/471 |
| 3,637,984 | 1/1972 | Irvine | 219/471 |
| 3,674,963 | 7/1972 | Serrano | 219/471 |
| 3,758,738 | 9/1973 | Otani | 219/471 |
| 4,035,612 | 7/1977 | Ishiguro et al. | 219/469 |
| 4,114,023 | 9/1978 | Zelinka | 219/471 |
| 4,127,764 | 11/1978 | Minden | 219/216 |
| 4,180,721 | 12/1979 | Watanabe et al. | 219/216 |

FOREIGN PATENT DOCUMENTS 2923169 12/1979 Fed. Rep. of Germany .

*Primary Examiner*—Roy N. Envall, Jr.
*Assistant Examiner*—Teresa J. Walberg
*Attorney, Agent, or Firm*—Albert C. Johnston

[57] ABSTRACT

A temperature-sensitive element on a rotatable drum of a copying machine changes a characteristic in response to a temperature on said drum. The characteristic is employed to control a temperature signal. The temperature signal from the drum is connected to stationary portions of the copying machine through sliding contacts. A control circuit responds to the temperature signal to control the energization of a heater to maintain the temperature of the drum at a predetermined value. The temperature signal and the control circuit complement each other to avoid errors caused by changes in resistance in the sliding contacts. In one embodiment, the temperature signal is a controlled current, independent of resistance in series with it, and the control circuit measures the current. In another embodiment, the temperature signal is a voltage and the control circuit measures the voltage using a circuit whose input impedance is so high that the resistances of the sliding contacts and their consequent voltage drops are negligible by comparison. In a third embodiment, the temperature signal is a frequency and the control circuit measures the frequency to determine the temperature.

8 Claims, 5 Drawing Figures

FUSER HEAT CONTROL CIRCUIT

This invention relates to a fuser heat control circuit for fixing powder images on a receiving material such as paper. In a plain paper copier, a heating element is employed to fuse a resin to the paper. The heating element may be a radiant device disposed adjacent to the paper path or it may be located in a rotatable drum which actually contacts the paper. A temperature-sensitive element forming part of a control circuit is customarily used for controlling the energy supplied to the heater element to maintain the temperature of the rotatable drum within predetermined limits. The temperature-sensitive element such as, for example, a thermistor, is conventionally mounted for rotation with the drum. The remainder of the control circuit is mounted on a stationary part of the apparatus. The drum-mounted temperature-sensitive element and the stationary remainder of the control circuit are interconnected through sliding contacts such as, for example, slip rings and brushes.

German Auslegeschrift No. 25 31 379 discloses an apparatus in which a temperature-sensitive element has a very low resistance which varies as a function of the temperature being measured. Resistance changes in sliding contacts in this apparatus are large compared to the temperature-induced changes in the temperature-sensitive element. Thus, temperature control is inaccurate.

Fuser control circuits must operate reliably and must maintain a constant temperature within very narrow limits, often to an accuracy of 1° C. Temperature control of this accuracy can be performed with a temperature-sensitive element of the variable-resistance type only if resistances connected in series with the temperature-sensitive element are negligible compared to the temperature-sensitive element or, at least are very constant. The resistance changes associated with such narrow temperature tolerances are so small that they are of magnitude of the known resistance variations experienced in sliding contacts. Thus, accurate temperature control may be disrupted by variations in the series resistance imposed by the sliding contacts.

The need for close temperature control of a fuser roll was disclosed in U.S. Pat. No. 4,127,764 wherein a stationary thermistor close to a heated rotatable drum produced a temperature-related signal which was used in a temperature controller to control the energization of a drum-mounted heater. Problems arising from the variable resistance of sliding contacts in series with the thermistor are neither recognized nor solved in this apparatus.

The variability of resistance in sliding contacts was recognized in U.S. Pat. No. 4,035,612. In this patent, a radio signal from an off-drum source is normally short circuited to ground through sliding contacts and a low resistance drum-mounted temperature-sensitive element. When the resistance of the sliding contacts increases, the radio frequency energy is no longer grounded but instead is detected to produce a warning signal.

The object of this invention is to provide a fuser heat control circuit which overcomes the drawbacks of the prior art.

A temperature-sensitive element in a first section of the control circuit determines the value of a temperature signal for measurement. A second section of the control circuit processes the temperature signal to control a heater. The first and second sections of the control circuit are joined by sliding contacts. The dynamic impedance of the first section of the control circuit for the temperature signal is high with respect to the impedance of the sliding contacts for the temperature signal so that the impedance of the sliding contacts has a negligible influence on the measurement of temperature.

Changes in the temperature-sensitive element in response to temperature variations are converted to types of signals which are relatively insensitive to variations in the resistance of the sliding contacts.

According to an aspect of the present invention, there is provided a fuser heat control circuit for controlling a temperature of a rotatable drum of an apparatus, comprising first means on the rotatable drum for producing a temperature signal having a characteristic related to the temperature, second means on a stationary part of the apparatus responsive to the temperature signal for controlling energization of a heater, at least one sliding contact interconnecting the temperature signal between the first and second means, and means for making the second means substantially unresponsive to changes in resistance of the at least one sliding contact.

According to a feature of the present invention, there is provided a fuser heat control circuit for controlling a temperature of a rotatable drum in a copying machine, comprising a temperature-sensitive resistor on the drum exposed to the temperature, a controlled current source on the drum, the controlled current source being effective to produce a current responsive to a resistance in the temperature-sensitive resistor and being substantially unresponsive to resistance in series with the current, first and second sliding contacts in series with the current effective to connect the current to stationary portions of the copying machine, a resistor on the stationary portions in series with the current, a differential amplifier effective to produce a signal responsive to a voltage across the resistor, a reference generator effective to generate a reference signal, a comparator effective to compare the reference signal and the signal and to produce a control signal in response to the comparison, a heater, a switch effective to control energization of the heater, and the switch being responsive to the control signal.

According to a further feature of the present invention, there is provided a fuser heat control circuit for controlling a temperature of a rotatable drum in a copying machine, comprising a temperature-sensitive resistor on the drum exposed to the temperature, a capacitor in parallel with the temperature-sensitive resistor on the drum, first and second sliding contacts connecting junctions of the temperature-sensitive resistor and the capacitor to at least a voltage measurement device on a stationary portion of the copying machine, a constant current source connectable to the junctions of the temperature-sensitive resistor and the capacitor whereby the capacitor is charged to a voltage determined by a resistance of the temperature-sensitive resistor and a constant current, the voltage measurement device having an input impedance which is high compared to a resistance of the first and second sliding contacts whereby the resistance has negligible effect on measurement of the voltage, a heater effective to heat the drum, and means for controlling the heater in response to the measurement of the voltage.

According to a further feature of the present invention, there is provided a fuser heat control for controlling a temperature of a rotatable drum in a copying machine, comprising a frequency generator on the drum, means for controlling a frequency from the frequency generator in response to the temperature, first and second sliding contacts effective to connect the frequency from the rotatable drum to a stationary portion of the copying machine, a frequency measuring device on the stationary portion responsive to the frequency to produce a signal in response thereto, means for comparing the signal to a reference signal, and means for controlling the heater in response to the signal.

The above-mentioned and other objects, features and advantages of the invention will be further evident from the following detailed description and the accompanying drawings of illustrative embodiment of the invention.

Figure 1:
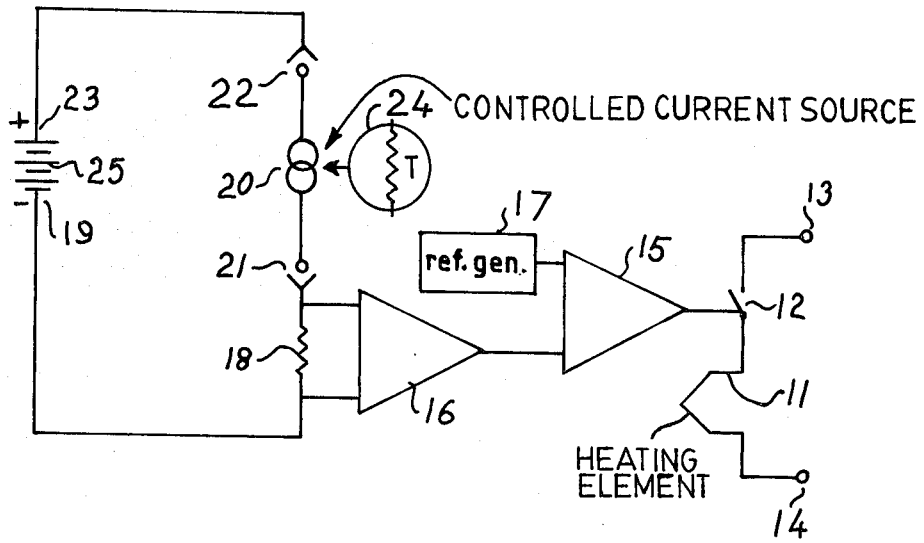
FIG. 1 shows a block diagram of a first embodiment of a fuser heat control circuit according to the invention.

Referring to FIG. 1, a heater element 11 is placed in series with heater power terminals 13 and 14 by closure of a switch 12. Power from a conventional power source (not shown) energizes the heater element 11. The switch 12 is controlled by a comparator 15 which compares an output signal from a differential amplifier 16 with a reference signal from a reference generator 17.

The differential amplifier 16 produces an output proportional to the voltage drop across a resistor 18. The resistor 18 is connected between a terminal 19 of a voltage source 25 and a sliding contact 21. Another terminal 23 of the voltage source 25 is connected to a sliding contact 22. A controlled current source 20 on a rotatable drum (not shown) is connected between the sliding contacts 21 and 22. A temperature-sensitive element 24 controls the magnitude of current delivered by the controlled current source 20 irrespective of the resistances in series with it.

The resistor 18, sliding contact 21, sliding contact 22 and the terminals 19 and 23 of the voltage source 25 are connected in series with the controlled current source 20. As a result of the series circuit, the current from the controlled current source 20 through the resistor 18 is controlled solely by the temperature to which the temperature-sensitive element 24 is exposed and is independent of the resistances connected in series with the controlled current source 20 and particularly independent of the resistance of the sliding contacts 21 and 22. As long as the resistance of the temperature-sensitive element 24 remains constant, the current produced by the controlled current source 20 also remains unchanged even in the presence of resistance variations in the sliding contacts 21 and 22. Thus, the voltage drop across the resistor 18 is proportional to the current from the controlled current source 20 and hence to the temperature to which the temperature-sensitive element 24 is exposed. The voltage output of the differential amplifier 16 is, therefore, also proportional to the temperature to which the temperature-sensitive element 24 is exposed. When the output of the differential amplifier 16 falls below a voltage supplied by the reference generator 17, the output of the comparator 15 changes from low to high and thus closes the switch 12, thus energizing the heater element 11. When the temperature sensed by the temperature-sensitive element exceeds a predetermined value, the output of the comparator returns to low, thus opening the switch 12 and de-energizing the heater element 11.

Figure 4:
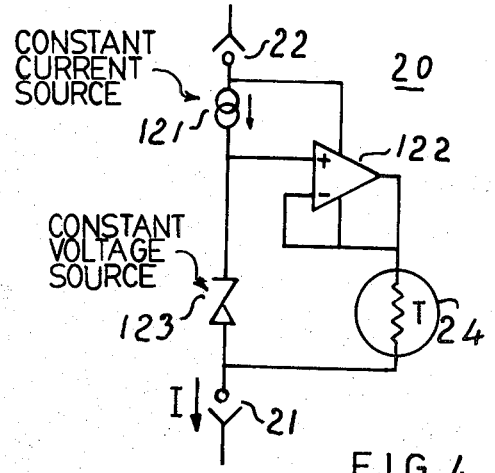
FIG. 4 shows a schematic and block diagram of a controlled current source suitable for use in the fuser heat control circuit of FIG. 1.

Referring to FIG. 4, the controlled source 20 of FIG. 1 includes a conventional constant current source 121 having one side connected to the sliding contact 22 and the other side connected to the plus input of an operational amplifier 122. The output of the operational amplifier 122 is fed back to its negative input. One of the feed voltage connections of the operational amplifier 122 is connected to the sliding contact 22 and the other feed voltage connection is connected to the negative input of the operational amplifier 122. The temperature-sensitive element 24, preferably a temperature-sensitive resistor, is connected between the output of the operational amplifier 122 and the sliding contact 21. A constant voltage source 123 is connected between the constant current source 121 and the sliding contact 21. The constant voltage source 123 may be, for example, a Zener diode.

The controlled current I flowing through the sliding contact 21 is made up of a constant current generated by the constant current source 121 and a variable controlled current fed from the output of the operational amplifier through the temperature-sensitive element 24. The input impedance of the operational amplifier 122 is very high. Substantially, all of the current from the constant current source 121 flows through the constant voltage source 123 to the sliding contact 21. The voltage at the junction of the constant current source 121 and the constant voltage source 123 remains constant with time. The operational amplifier 122 is connected as a voltage follower. Since the voltage at its positive input remains constant, the output voltage of the operational amplifier 122 must also remain constant. Consequently, the voltage across the temperature-sensitive element 24 must not change. Since the resistance of the temperature-sensitive element 24 changes in response to temperature changes, the output current of the operational amplifier 122 must change in order to maintain the voltage across the temperature-sensitive element 24 constant. Since the current I is the sum of current delivered by the constant current source 121, which is constant, and the current delivered by the output of the operational amplifier 122 which varies with temperature, this sum changes to a degree determined by the resistance changes of the temperature-sensitive element 24. However, current I is insensitive to resistance in series with it.

Figure 5:
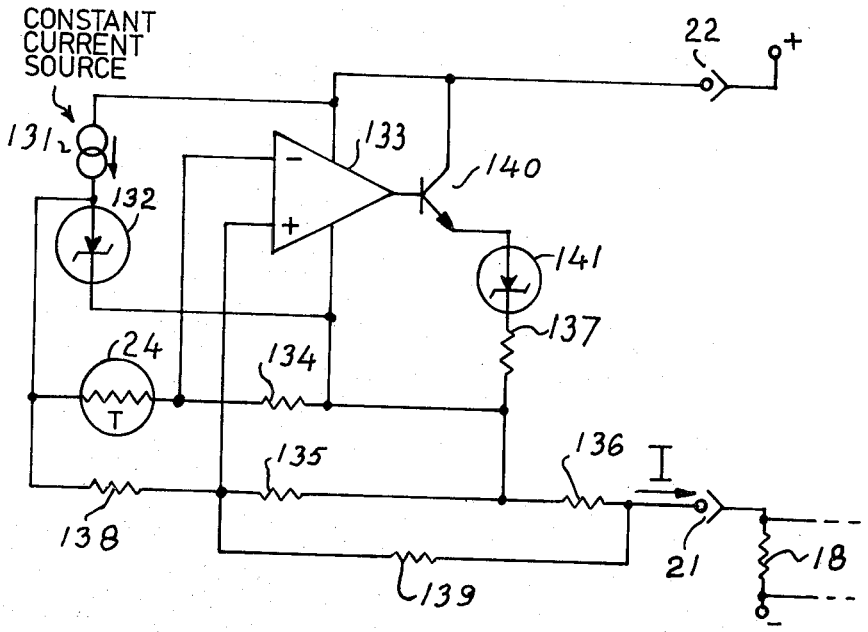
FIG. 5 shows a schematic and block diagram of a further controlled current source suitable for use in the fuser heat control circuit of FIG. 1.

FIG. 5 shows a developed circuit constructed according to the principle of FIG. 4 but with higher sensitivity due to the use of a bridge circuit. The sliding contact 22 is connected to one side of a conventional constant current source 131, the other side of the constant current source 131 is connected to a first side of a Zener diode 132. The other side of the Zener diode 132 is connected to a feed voltage connection of an operational amplifier 133 and to one side of the resistors 134, 135, 136 and 137. The other side of the resistor 134 is connected to a temperature-sensitive resistor 24 and to the negative input of the operational amplifier 133. The other side of the temperature-sensitive resistor 24 is connected to the junction of the constant current source 131 and the Zener diode 132. This junction is also connected to one side of the resistor 138, the other side of which is connected to the positive input of the operational amplifier 133 and to the other side of the resistor 135. A resistor 139 is connected from the junction of the resistors 135 and 138 to the other side of the resistor 136. The junction of the resistors 136 and 139 is connected to the sliding contact 21. The output of the operational amplifier 133 is connected to the base of a transistor 140. The collector of the transistor 140 is connected to the sliding contact 22. The emitter of the transistor 140 is connected to one side of a Zener diode 141. The other side of the Zener diode 141 is connected to the other side of the resistor 137. The resistance values of the resistors 134, 135 and 139 are equal to one another and are high with respect to the resistance of the resistors 136 and 138 and the nominal resistance of the temperature-sensitive resistor 24. The amplification factor of the operational amplifier 133 is very high so that there is practically no voltage difference between the positive and negative inputs. The current I through the sliding contact 21 is directly proportional to the resistance of the temperature-sensitive resistor 24 plus a constant. The current through the sliding contact 21 can be determined in the manner described in connection with FIG. 1 so that the energization of the heater element 11 is suitably controlled to maintain the temperature to which the temperature-sensitive resistor 24 is exposed substantially constant.

Figure 2:
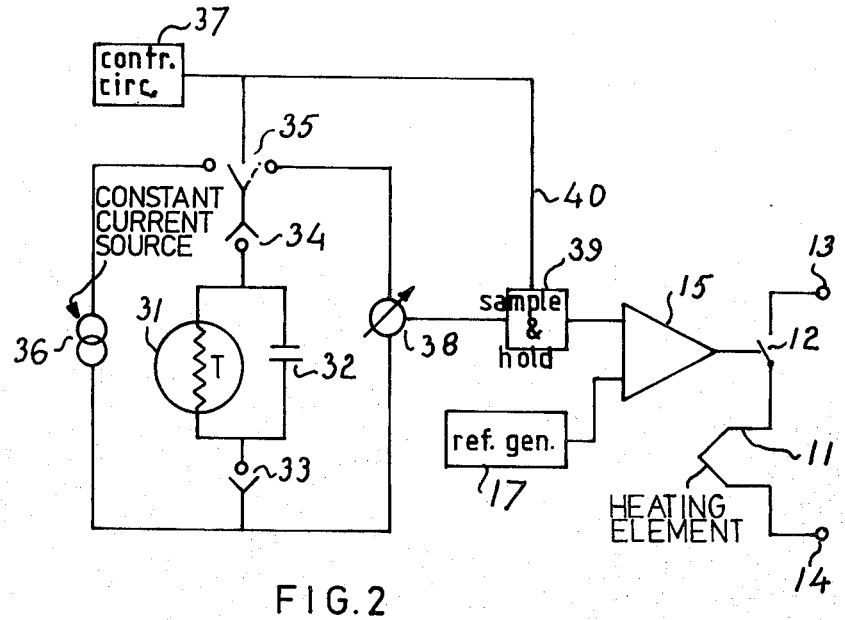
FIG. 2 shows a block diagram of a second embodiment of a fuser heat control circuit according to the invention.

Referring to FIG. 2, the temperature-sensitive element is a temperature-dependent resistor 31 connected between sliding contacts 33 and 34. A capacitor 32 is connected in parallel with the temperature-dependent resistor 31. The temperature-dependent resistor 31 and the capacitor 32 may be connected to a constant current source 36 through the sliding contact 33, the sliding contact 34 and one contact of a switch 35. The other contact of the switch 35 connects a high-impedance voltage measuring circuit 38 in parallel with the temperature-dependent resistor 31 and the capacitor 32 through the sliding contacts 33 and 34. A conventional control circuit 37 controls the position of the switch 35. The voltage measuring circuit 38 is connected to a sample and hold circuit 39. The sample and hold circuit 39 is controlled by a signal on a line 40 from the control circuit 37. The output of the sample and hold circuit 39 is applied to an input of the comparator 15.

When the switch 35 is in the first position, the constant current source 36 produces a constant current through the parallel circuit of the temperature-dependent resistor 31 and the capacitor 32. This current is constant regardless of the resistance in series with it. Initially, with the capacitor 32 uncharged, the constant current charges up the capacitor 32. As the capacitor 32 becomes charged, the voltage across it increases and current flows through the temperature-dependent resistor 31. At equilibrium, no current flows into the capacitor 32 and the voltage across it is equal to the resistance of the temperature-dependent resistor 31 multiplied by the constant current delivered by the constant current source 36. Since the current delivered by the constant current source 36 is independent of resistances in series with it, the voltage developed across the temperature-dependent resistor 31 is independent of changes in the resistance of sliding contacts 33 and 34 but instead is solely responsive to the change in its own resistance produced by the temperature to which is it exposed.

The control circuit 37 changes the position of the switch 35 to its position which places the voltage on the capacitor 32 across the voltage measuring circuit 38. The voltage measuring circuit 38, which may be, for example, an amplifier having a high input impedance, produces an output voltage which is proportional to its input voltage. The voltage across the capacitor 32 decreases with time as a result of the charge leaking through the temperature-dependent resistor 31. The voltage across the capacitor 32 must, therefore, be measured at a specific time after the switch 35 has been set to its second position. This is accomplished by the control signal on the line 40 from the control circuit 37 which enables the sample and hold circuit 39 to sample and hold the output of the voltage measuring circuit 38 at a specific time following actuation of the switch 35. Since the input impedance of the voltage measuring cricuit 38 is very high, the resistance of the sliding contacts 33 and 34 including any minor variations therein is negligible by comparison and, therefore, has negligible influence on the result of the measurement of the voltage on the capacitor 32. The result of the voltage measurement held in the sample and hold circuit 39 is compared in comparator 15 with the reference signal from the reference generator 17. The result of this comparison is used to actuate the switch 12 as in the previous embodiment. The control circuit 37 re-sets the switch 35 to its first position and the above-described cycle is repeated. Since the voltage measuring circuit 38 measures a D.C. voltage, the dynamic impedance of the capacitor 32 is very high with respect to the impedance of the sliding contacts 34, so that the latter does not influence the result of the measurement.

Figure 3:
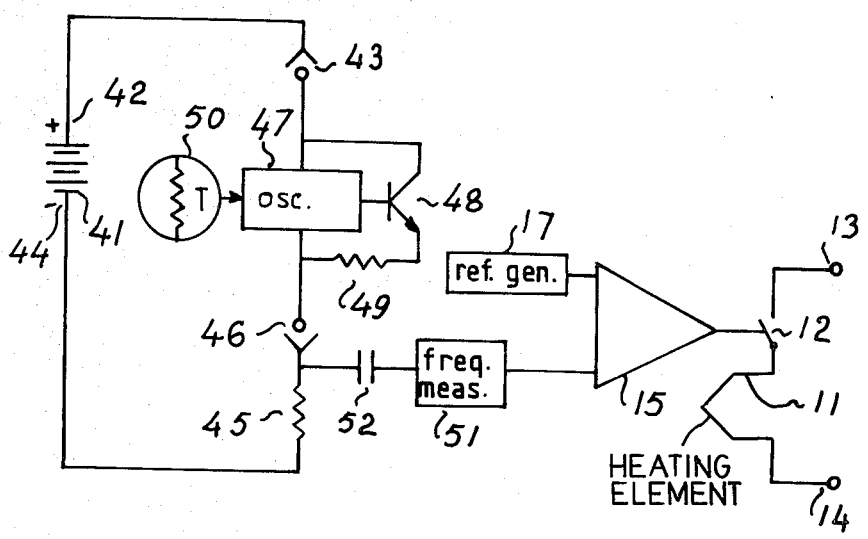
FIG. 3 shows a block diagram of a third embodiment of a fuser heat control circuit according to the invention.

Referring to FIG. 3, a terminal 42 of a voltage source 41 is connected through a sliding contact 43 to an oscillator 47. A terminal 44 of the voltage source 41 is connected through a measuring resistor 45 and a sliding contact 46 to the oscillator 47. An output of the oscillator 47 is connected to the base of a transistor 48 whose collector is connected to the sliding contact 43 and whose emitter is connected through a resistor 49 to the sliding contact 46. The collector-emitter path of the transistor 48 thus bypasses the oscillator 47 and modulates the feed current flowing through resistor 45 at a frequency determined by the oscillator 47. The frequency of the signal generated by the oscillator 47 is controlled by the value of a temperature-sensitive element 50. A capacitor 52 connected to the junction of the sliding contact 46 and the measuring resistor 45 applies a sample of the frequency to a frequency measuring circuit 51. The output of the frequency measuring circuit 51 is connected to a first input of the comparator.

A second input of the comparator 15 receives a reference voltage from the reference generator 17. The output of the comparator 15 controls the switch 12 and energizes the heater element 11 as in the preceding embodiments.

In operation, the oscillator 47 receives feed voltage through the sliding contacts 43 and 46 and produces an output signal whose frequency is dependent upon the value of the temperature-sensitive element 50. The output of the oscillator 47 modulates the current through the transistor 48 and resistors 49 and 45. The current through the resistors 49 and 45, therefore, contains an A.C. voltage component whose frequency is related to the value of the temperature-sensitive element 50 and, therefore, to the temperature being measured. The A.C. voltage component across the measuring resistor 45 is fed through the capacitor 52 to the frequency measuring circuit 51. The frequency measuring circuit 51 may be, for example, a phase locked loop which produces a D.C. voltage dependent upon the frequency of the signal at the input. The comparator 15 compares the D.C. voltage from the frequency measuring circuit 51 with the reference signal from the reference generator 17 and actuates the switch element 12 to control the energization of the heater element 11 as in previous embodiments.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A fuser heat control circuit for controlling a temperature of a rotatable drum on an apparatus, comprising:

first means on said rotatable drum for producing a temperature signal having a characteristic related to said temperature;

second means on a stationary part of said apparatus responsive to said temperature signal for controlling energization of a heater;

at least one sliding contact interconnecting said temperature signal between said first and second means; and means for making said second means substantially unresponsive to changes in resistance of said at least one sliding contact;

said first means being a controlled current source effective to produce a current related to said temperture and substantially unresponsive to resistance in series with said current, said second means including a resistor in series with said current and means for controlling energization of said heater in response to a voltage developed by said current across said resistor;

said means for controlling energization including a differential amplifier responsive to a difference in voltage between opposed ends of said resistor to produce a signal related to said difference, a reference signal generator effective to produce a reference signal and a comparator effective to compare said signal and said reference signal and to control energization of said heater in response to the comparison.

2. A fuser heat control circuit for controlling a temperature of a rotatable drum on an apparatus, comprising:

first means on said rotatable drum for producing a temperature signal having a characteristic related to said temperature;

second means on a stationary part of said apparatus responsive to said temperature signal for controlling energization of a heater;

at least one sliding contact interconnecting said temperature signal between said first and second means; and means for making said second means substantially unresponsive to changes in resistance of said at least one sliding contact;

said first means being a controlled current source effective to produce a current related to said temperature and substantially unresponsive to resistance in series with said current, said second means including a resistor in series with said current and means for controlling energization of said heater in response to a voltage deveoped by said current across said resistor;

said controlled current source including a constant current source effective to produce a constant current irrespective of resistance in series therewith and a variable current source effective to produce a variable current responsive only to said temperature, said temperature related current being a sum of said constant current and said variable current.

3. A fuser heat control circuit according to claim 2, wherein said variable current source includes a resistive bridge, one element of said resistive bridge being a temperature-sensitive resistor, said resistive bridge controlling an operational amplifier in proportion to an unbalance thereof, said operational amplifier controlling said variable current.

4. A fuser heat control circuit for controlling a temperature of a rotatable drum on an apparatus, comprising:

first means on said rotatable drum for producing a temperature signal having a characteristic related to said temperature;

second means on a stationary part of said apparatus responsive to said temperature signal for controlling energization of a heater;

at least one sliding contact interconnecting said temperature signal between said first and second means; and means for making said second means substantially unresponsive to changes in resistance of said at least one sliding contact;

said temperature signal being a current responsive only to said temperature and unresponsive to resistance in series therewith whereby changes in resistance of said at least one sliding contact in series with said temperature signal do not affect control of said temperature.

5. A fuser heat control circuit for controlling a temperature of a rotatable drum on an apparatus, comprising:

first means on said rotatable drum for producing a temperature signal having a characteristic related to said temperature;

second means on a stationary part of said apparatus responsive to said temperature signal for controlling energization of a heater;

at least one sliding contact interconnecting said temperature signal between said first and second means; and means for making said second means substantially unresponsive to changes in resistance of said at least one sliding contact;

said characteristic being a voltage and said means for making said second means substantially unresponsive including a voltage measuring circuit having an input impedance which is high compared to a resistance of said at least one sliding contact;

said first means including a temperature-sensitive resistor in parallel with a capacitor, said second means including a constant current source and a switch, said switch having a first position effective to connect said constant current source to the parallel combination of said temperature-sensitive resistor and said capacitor, said switch having a second position effective to connect at least said capacitor to said voltage measuring circuit.

6. A fuser heat control circuit according to claim 5, wherein said second means further includes a control circuit and a sample and hold circuit, said control circuit being effective to control placement of said switch in its first and second positions, said control circuit being further effective to enable said sample and hold circuit to sample a voltage from said voltage measuring circuit at a predetermined time after said switch is placed in its second position, and means for comparing an output of said sample and hold circuit with a reference signal for controlling energization of said heater.

7. A fuser heat control circuit for controlling a temperature of a rotatable drum in a copying machine, comprising:

a temperature-sensitive resistor on said drum exposed to said temperature;

a controlled current source on said drum, said controlled current source being effective to produce a current responsive to a resistance in said temperature-sensitive resistor and being substantially unresponsive to resistance in series with said current;

first and second sliding contacts in series with said current effective to connect said current to a heat control system on stationary portions of said copying machine; said heat control system including:

a resistor in series with said current;

a differential amplifier effective to produce a signal responsive to a voltage across said resistor;

a reference generator effective to generate a reference signal;

a comparator effective to compare said reference signal and said voltage responsive signal and to produce a control signal in response to the comparison;

a heater; and a switch effective to control energization of said heater; said switch being responsive to said control signal.

8. A fuser heat control circuit for controlling a temperature of a rotatable drum in a copying machine, comprising:

a temperature-sensitive resistor on said drum exposed to said temperature;

a capacitor in parallel with said temperature-sensitive resistor on said drum;

first and second sliding contacts connecting junctions of said temperature-sensitive resistor and said capacitor to at least a voltage measurement device on a stationary portion of said copying machine;

a constant current source connectable to said junctions of said temperature-sensitive resistor and said capacitor whereby said capacitor is charged to a voltage determined by a resistance of said temperature-sensitive resistor and a constant current;

said voltage measurement device having an input impedance which is high compared to a resistance of said first and second sliding contacts whereby said resistance has negligible effect on measurement of said voltage;

a heater effective to heat said drum; and means for controlling said heater in response to said measurement of said voltage.

* * * * *